United States Patent [19]

Guy

[11] Patent Number: 4,790,609

[45] Date of Patent: Dec. 13, 1988

[54] COMBINATION FOLDABLE-SCREEN ROOM DIVIDER AND CURIO CABINET

[76] Inventor: Richard Guy, 28052 Camino Capistrano, Laguna Niguel, Calif. 92677

[21] Appl. No.: 390,908

[22] Filed: Jun. 22, 1982

[51] Int. Cl.[4] ..... A47F 3/00

[52] U.S. Cl. ..... 312/117; 160/135; 312/114; 312/242; 312/248

[58] Field of Search ..... 312/245, 246, 247, 248, 312/242, 114, 117; 160/135, 351; 52/79.5

[56] References Cited

U.S. PATENT DOCUMENTS

| | | | |
|---|---|---|---|
| D. 206,304 | 11/1966 | Pinzke . | |
| 454,328 | 6/1891 | Buchholz | 160/135 |
| 1,035,015 | 8/1912 | Johnson | 312/114 |
| 1,086,526 | 2/1914 | Hall . | |
| 1,625,011 | 4/1927 | Wolfe et al. | 312/245 |
| 2,131,680 | 9/1938 | Zahodiakin | 312/242 |
| 2,445,164 | 7/1948 | Worthman . | |
| 2,938,248 | 5/1960 | Hadary | 160/351 |
| 3,224,489 | 12/1965 | Haberthier | 160/135 |
| 3,817,396 | 6/1974 | Markson | 211/178 |
| 3,869,183 | 3/1975 | Frank, Jr. | 312/248 |
| 3,889,736 | 6/1975 | Firks | 160/135 |
| 4,001,987 | 1/1977 | Coulthard | 248/231 |
| 4,334,571 | 6/1982 | Heller et al. | 160/135 |

FOREIGN PATENT DOCUMENTS

| | | | |
|---|---|---|---|
| 511013 | 5/1952 | Belgium | 312/245 |
| 659814 | 7/1929 | France | 312/114 |

*Primary Examiner*—Peter A. Aschenbrenner
*Assistant Examiner*—Thomas A. Rendos
*Attorney, Agent, or Firm*—Francis X. LoJacono

[57] ABSTRACT

A foldable-screen room divider in combination with a curio cabinet, wherein the room divider is defined by at least three screen sections, the central or intermediate screen section having a curio cabinet mounted thereon, so as to allow ornamental objects or articles to be stored and displayed. The curio cabinet can be mounted in two modes. In one arrangement, the cabinet is hinged to the center screen section for access to the section having a transparent panel. In the other arrangement, the curio cabinet is fixed to the screen section which has a hinged door provided with a transparent panel for viewing the interior of the curio cabinet. The side screen sections are hinged to the central section and can be adapted with ornamental panels.

4 Claims, 2 Drawing Sheets

FIG. 1
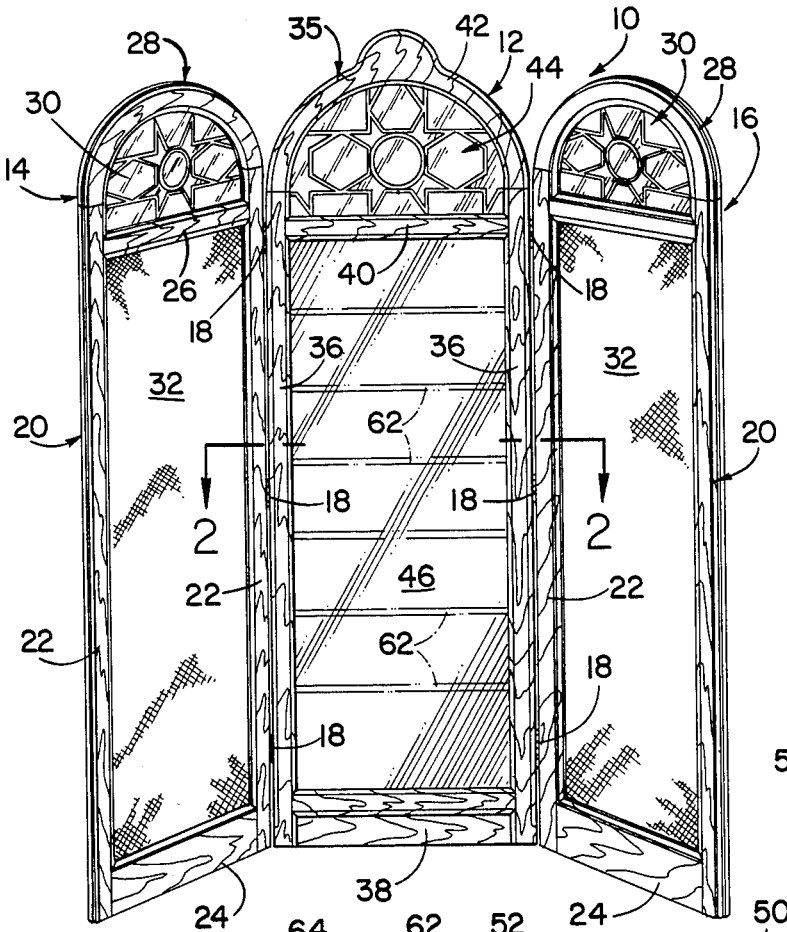
FIG. 3
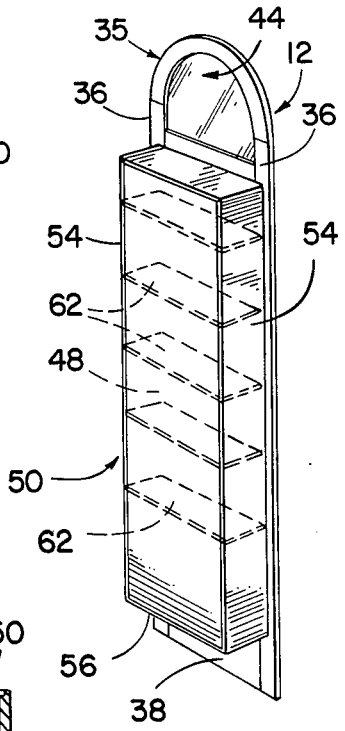
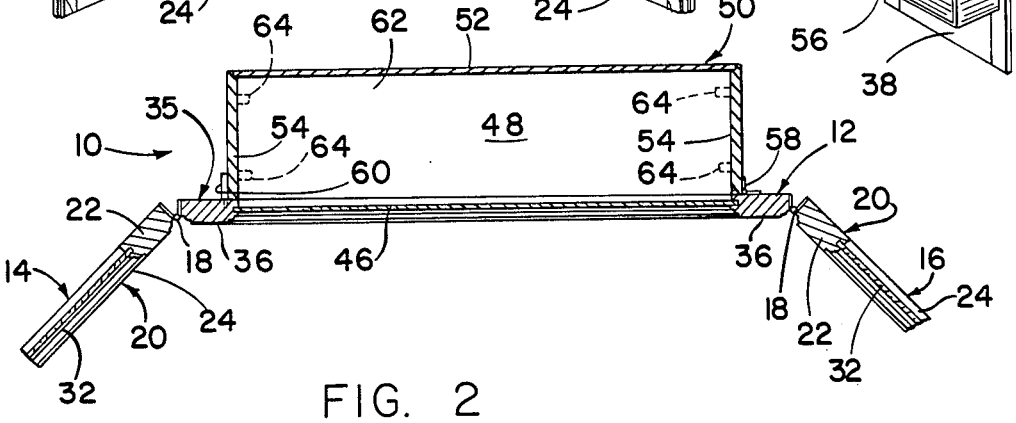
FIG. 2

COMBINATION FOLDABLE-SCREEN ROOM DIVIDER AND CURIO CABINET

BACKGROUND OF THE INVENTION

1. Field of the Invention

This invention relates generally to a foldable free-standing screen which is commonly used as a room divider, and more particularly to a foldable free-standing screen having a curio cabinet formed as part of at least one screen section.

2. Description of the Prior Art

There are many known types of room dividers that include some form of screening device. Most of these, however, comprise basically a plurality of interconnected screen sections that define foldable panels.

There are generally two types of screening devices or apparatuses. One type is specifically designed to be used as a portable display assembly wherein the screen construction is applicable for exhibition and display purposes, such as disclosed in U.S. Pat. No. 4,001,987 to James A. Coulthard. This unit comprises a plurality of support members of elongated configuration and uniform circular cross section having a plurality of rectangular panels, and a plurality of clips used to secure the panels in place on the support members. The panels are generally rectangular in shape and can be contiguously or randomly positioned to define various screening arrangements. Further, the apparatus of this invention is particularly desinged for simple assembly or disassembly of its parts for shipping and relocating.

Another screen-type portable display apparatus is disclosed in U.S. Pat. No. 3,817,396 to David E. Markson which is also designed to be assembled and disassembled. This apparatus is of lightweight construction and comprises a plurality of display units joined together in a side-by-side relationship. Each display unit is formed by a pair of skeletal frames made of metal tubing and hinged together along one common side, so that one of the frames can be swung above the other. Each of these skeletal frames includes a pair of inwardly facing track means provided on the opposite upstanding sides, in order to slidably mount a pair of lightweight insert panels. A support unit is fastened to each end of the unitary display structure to retain it in an upstanding position.

Another type of screening device or apparatus is the one used as a room divider and generally defining an ornamental folding screen unit having a plurality of screen sections, as illustrated and disclosed in U.S. Pat. No. 3,224,489 to Vincent G. Haberthier. This form of divider is used extensively in interior decoration, particularly where visual separation or division of areas is desired. The most commonly used divider of this type includes three-panel screen sections, while others have as many as six sections. The combination of a larger number of sections is employed to a lesser degree because of excessive weight and difficulty in setting-up and adjusting them.

The Haberthier patent comprises a plurality of screens adapted to be folded in other arrangements than for use as a divider. Variations in the locking arrangement permit the selective shaping of the assembly into various configurations, such as a room divider, a server, a desk, or a support for articles, wherein consoles may be mounted on fore or aft portions of the assembly. It further is adapted to form a closet or storage container.

SUMMARY AND OBJECTS OF THE INVENTION

The present invention has for an important object to provide an ornamental folding screen which can be employed as a room divider, and which additionally includes in its basic construction a curio cabinet where articles can be stored and displayed as part of the overall decoration.

It is another object of the invention to provide a combination foldable-screen room divider and a curio cabinet wherein a plurality of hinged screen sections (preferably three sections) can be arranged as a self-standing assembly, one or all of the screen sections being formed to include a curio cabinet for storing and displaying various ornamental artifacts therein.

It is still another object of the invention to provide a combination foldable-screen room divider and curio cabinet wherein the curio cabinet is formed as part of the central screen section, and the two oppositely arranged screen sections are hingedly connected to the center screen—thereby establishing a room divider that can be placed within a room in a very pleasing ornamental fashion, without the need for additional space that would normally be required for a separate piece of furniture such as a china cabinet.

It is a further object of the invention to provide a foldable-screen room divider of this character wherein the framework can be constructed from a suitable material, preferably an ornamental wood frame having hinged doors with glass inserts for access to the shelves within the cabinet area.

Still another object of the present invention is to provide a room divider of this character wherein the curio cabinet is hinged to a selected screen section, a glass viewing panel being fixedly mounted within the frame of the screen section.

It is still another object of the invention to provide a combination foldable-screen room divider and curio cabinet of this character wherein the cabinet structure is fixedly mounted to the framework of the central screen section, the screen section being provided with a door for access to the interior cabinet area.

It is still a further object of the invention to provide an apparatus of this type that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of the present invention having a central screen section and two oppositely positioned side screen sections, the central screen including a curio cabinet that is hingedly mounted thereto;

FIG. 2 is an enlarged cross-sectional view taken substantially along line 2—2 of FIG. 1;

FIG. 3 is a rear-perspective view of the central screen section and the curio cabinet attached thereto;

DESCRIPTION OF THE PREFERRED EMBODIMENT

Figure 4:
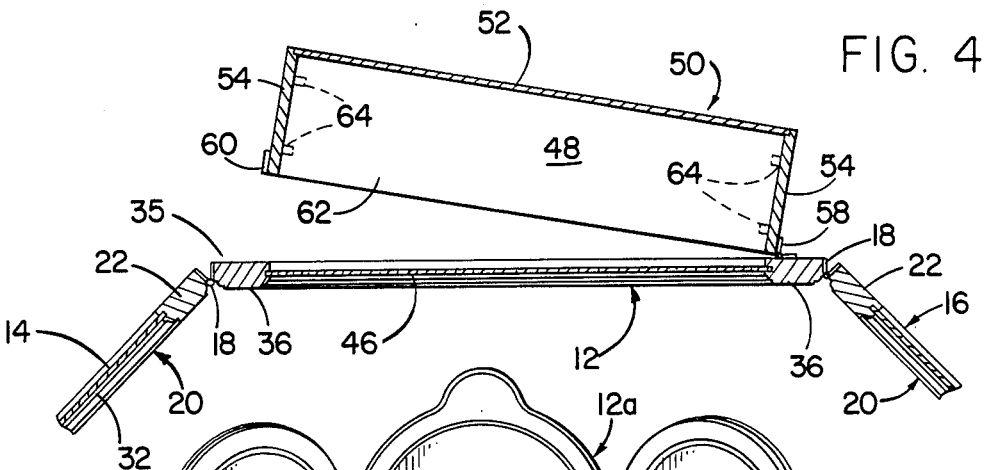
FIG. 4 is a cross-sectional view, similar to that of FIG. 2, with the curio cabinet shown in an open position relative to the central screen section.

Referring more particularly to FIGS. 1 through 4, there is illustrated a combination foldable-screen room divider and curio cabinet, generally indicated at 10, which depicts one of the embodiments herein claimed. The present invention comprises a plurality of screen sections, more specifically a three-section screen divider having a central or intermediate screen section 12, and a pair of oppositely disposed side screen sections 14 and 16, respectively. The side sections 14 and 16 are hinged along one edge to the central section by means of hinges 18. The hinges can be any suitable type that allow the side screens to be folded, whereby the room divider as a single unit can be readily folded for moving or shipping—above all allowing the side screen sections to be adjustable in a suitable angular arrangement to establish a stable upright position of the unit as a whole. Thus the unit can be readily positioned to accommodate various room sizes and decors.

Each side screen section includes a structure having a substantially rectangular framework 20, which can be formed from any suitable material, but preferably from wood. Hence, framework 20, as herein illustrated, includes elongated vertical side frame members 22, bottom member 24, and an upper cross member 26. Since there are numerous ornamental designs and configurations that can be adapted to the basic framework 20, there is shown a top frame portion 28 formed having an arcuate shape in which several glass panels 30 are installed.

Various ornamental decorations can be provided within the framework 20 defined by panel 32. This panel may be constructed from a variety of materials or choice of colors to provide a decorative effect in harmony with the color and/or decor of the room in which the unit is to be located. Again, this panel can also be formed from glass as indicated at 30. Accordingly, the cross-sectional configuration of the framework members would appropriately accommodate whatever type of panel might be selected.

The central or intermediate screen section is also formed having a similar framework, generally indicated at 35, which includes elongated vertical side members 36, lower cross member 38, and upper cross member 40, the side members 36 being extended to form an arcuate portion 42 for additional ornamental design, which can be suitably varied to include fabrics as well as glass or translucent panels, such as indicated at 44.

In the embodiment shown herein in FIGS. 1, 2 and 4 the framework 35 is adapted to receive a full transparent panel, preferably glass 46. This panel is affixed or suitably mounted in the framework, thus in effect providing a window for viewing the storage area 48 within the curio-cabinet portion, indicated generally at 50.

The curio cabinet comprises a substantially rectangular box-like structure having a full back wall 52, side walls 54, and end walls 56. Accordingly, hinge means 58 are provided as well as a latching means indicated at 60, the hinge and latch means being attached on opposite side walls from each other whereby the hinge 58 mounts the curio cabinet to frame member 36 in a suitable manner to allow the cabinet to be readily opened, as shown in FIG. 4, and to provide access to storage area 48 which is adapted to receive a plurality of shelf members 62 supported by suitable adjustable support means, such as indicated at 64.

Figure 5:
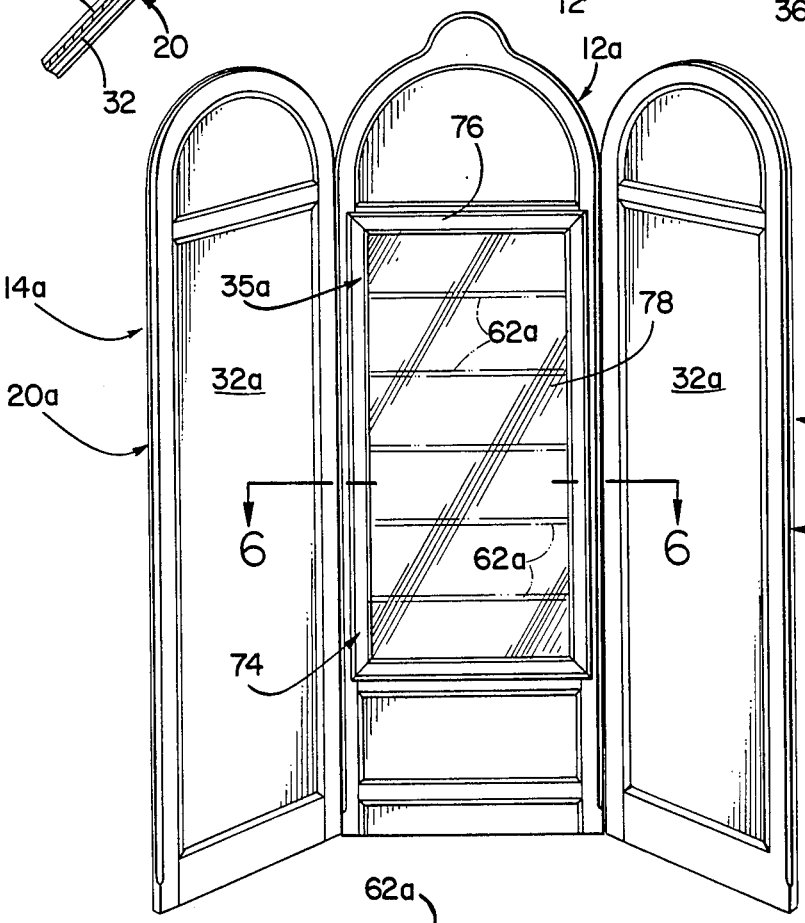
FIG. 5 is a pictorial view of an alternative arrangement of the present invention, wherein the curio cabinet is fixed secured to the central screen section and a front hinged door is provided for access to the inside cabinet area thereof.
Figure 6:
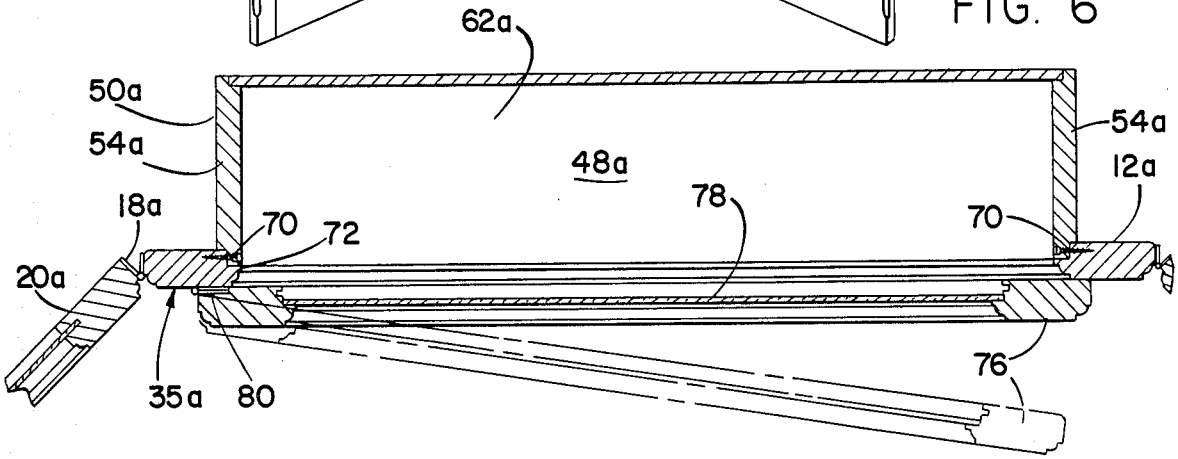
FIG. 6 is an enlarged cross-sectional view taken substantially along line 6—6 of FIG. 5, showing the cabinet door closed and hinged to the screen section framework.

Reference is made now to the second embodiment which is illustrated in FIGS. 5 and 6. As shown herein, this embodiment is similar in its overall concept to that shown and described heretofore. That is, a plurality of screen sections are employed, preferably three sections—a central or intermediate section 12a, and side screen sections 14*a* and 16*a*, respectively. The side sections can be provided with any suitable ornamental design, and the rectangular framework 20*a* includes at least one panel 32*a*, as previously described.

The side screens 14*a* and 16*a* are preferably hingedly secured at 18a to the central screen section 12*a*. However, central screen section 12*a* is formed to fixedly support curio cabinet 50*a* by means of suitable fasteners, such as indicated by screws 70 which are located along the edge of side walls 54*a*, so as to engage the peripheral inner edge of the framework opening 72. Hence, curio cabinet 50*a* is mounted to framework 35*a* in a permanent manner, whereby access to storage area 48a, which includes adjustable shelves 62*a*, is through opening 72 of the central screen section.

In order to establish a sealed or closed-off storage area, there can be further provided a cabinet door, indicated at 74, having a framestructure to correspond to opening 72. The cabinet door can be formed in any desired shape, but is herein shown in the preferable rectangular mode 76 adapted to receive a transparent panel or sheet of glass 78 for viewing the interior of the cabinet, the door being hinged along one edge such as indicated at 80. FIG. 6 shows the door in a closed position and in an open position by means of phantom lines.

It should be noted that the cabinet need not cover the full length of the screen section, and it is further contemplated that the side sections or any screen sections that might be added to the examples herein shown will also be provided with curio cabinets in the same manner as described for the central screen section.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An ornamental foldable-screen room divider and curio cabinet in combination, comprising:

a plurality of foldable upright screen sections hingedly interconnected to define said room divider;

hinge means disposed along the adjacent edges of said screen sections to allow said screen sections to be folded or angularly positioned to establish the stable upright position for said room divider;

a curio cabinet attached to at least one of said screen sections; and means to provide access to said curio cabinet;

wherein said access means comprises means for hinging said curio cabinet along one edge thereof to said screen section, and wherein said section is provided with a transparent panel to cover said curio cabinet in a closed position, and to allow the viewing of the interior of said curio cabinet.

2. An ornamental foldable-screen room divider and curio cabinet in combination, comprising:

a plurality of foldable upright screen sections hingedly interconnected to define said room divider;

hinge means disposed along the adjacent edges of said screen sections to allow said screen sections to be folded or angularly positioned to establish the stable upright position for said room divider;

a curio cabinet attached to at least one of said screen sections; and means to provide access to said curio cabinet;

wherein at least three screen sections defining said room divider comprise an intermediate screen section and oppositely disposed hinged side screen sections, said curio cabinet being mounted to said intermediate screen section; and wherein each of said side screen sections comprises a framework having an ornamental panel mounted therein, said intermediate screen section comprises a framework having a transparent fixed panel for viewing the interior of said curio cabinet section, and said access means comprises means for hinging said curio cabinet to said framework of said intermediate screen section rearwardly of said transparent panel.

3. The combination as recited in claim 2, wherein said curio cabinet includes a plurality of adjustable shelf members.

4. The combination as recited in claims 3 , wherein said curio cabinet comprises:

a pair of oppositely disposed side walls;

a pair of oppositely disposed end walls; and a rear wall;

said walls together defining a box-like configuration.

* * * * *